United States Patent [19]

Chibana

[11] 4,386,547

[45] Jun. 7, 1983

[54] ELECTRONIC MUSICAL INSTRUMENT

[75] Inventor: Manobu Chibana, Hamamatsu, Japan

[73] Assignee: Nippon Gakki Seizo Kabushiki Kaisha, Shizuoka, Japan

[21] Appl. No.: 259,907

[22] Filed: May 4, 1981

Related U.S. Application Data

[63] Continuation of Ser. No. 77,319, Sep. 20, 1979, abandoned.

[30] Foreign Application Priority Data

Sep. 25, 1978 [JP] Japan ..... 53-116692

[51] Int. Cl.[3] ..... G10H 1/06

[52] U.S. Cl. ..... 84/1.22; 84/1.01

[58] Field of Search ..... 84/1.01, 1.19, 1.23, 84/1.24, 1.22

[56] References Cited

U.S. PATENT DOCUMENTS 3,913,442 10/1975 Deutsch ..... 84/1.19

4,083,285 4/1978 Chibana ..... 84/1.26

4,108,040 8/1978 Chibana et al. ..... 84/1.19

4,132,140 2/1979 Chibana ..... 84/1.19 X

*Primary Examiner*—B. Dobeck

*Assistant Examiner*—Forester W. Isen

*Attorney, Agent, or Firm*—Thompson, Birch, Gauthier & Samuels

[57] ABSTRACT

There are provided a circuit for producing a fundamental wave and harmonic components thereof, an amplitude coefficient generator for generating amplitude coefficient respectively corresponding to the harmonic components, a multiplier for multiplying an output of the synthesizer with an output of the amplitude coefficient generator to obtain products, and synthesizing means for synthesizing the products for forming a musical tone. The synthesizer comprises an increment component generator, and an accumulator for accumulating the increment component, thereby forming amplitude coefficients for the harmonic components.

9 Claims, 8 Drawing Figures

ELECTRONIC MUSICAL INSTRUMENT

This is a continuation of application Ser. No. 77,319 filed Sept. 20, 1979 now abandoned.

BACKGROUND OF THE INVENTION

This invention relates to an electronic musical instrument, more particularly an electronic musical system utilizing a novel harmonic synthesizing system.

A typical electronic musical instrument of the harmonic synthesizing type utilizing digital technique is disclosed in U.S. Pat. No. 3,809,786 dated May 7, 1974. In the electronic musical instrument disclosed therein, setting of the amplitude values of respective harmonics constituting a musical tone to be generated by the musical instrument is made by harmonic amplitude coefficients which have been stored in a harmonic coefficient memory device. However, since the harmonic amplitude coefficients do not vary with time, the same waveform of the generated musical tone is repeated from the beginning to the end of the musical tone with the result that the color of the generated tone is constant and does not vary with lapse of time.

In contrast, the tone color, that is the waveform, of the musical tones generated by natural musical instruments varies delicately between the beginning and the end, thus making musical tones rich in naturalness.

SUMMARY OF THE INVENTION

Accordingly, it is an object of this invention to provide an improved electronic musical instrument capable of variously varying with time the tone color of the generated musical tone.

According to this invention, there is provided an electronic musical instrument comprising first means for producing a fundamental wave and harmonic components thereof, second means for generating amplitude coefficients respectively corresponding to the harmonic components, means for multiplying an output of the first means with an output of the second means to obtain multiplication products, and means to synthesize the products for forming a musical tone, the second means comprising means for generating an increment component, and means for accumulating the increment component thus generated, thereby forming timewisely varying amplitude coefficients for the respective harmonic components.

DESCRIPTION OF THE PREFERRED EMBODIMENTS

Before describing the preferred embodiments of this invention, the principle and feature thereof will firstly be outlined.

Figure 1:
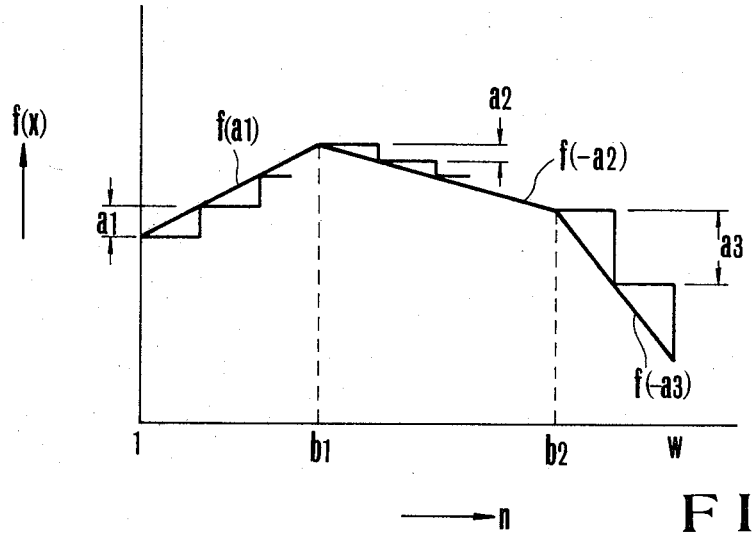
FIGS. 1 and 2 are graphs adapted to explain the principle and feature of the electronic musical instrument embodying the invention.
Figure 2:
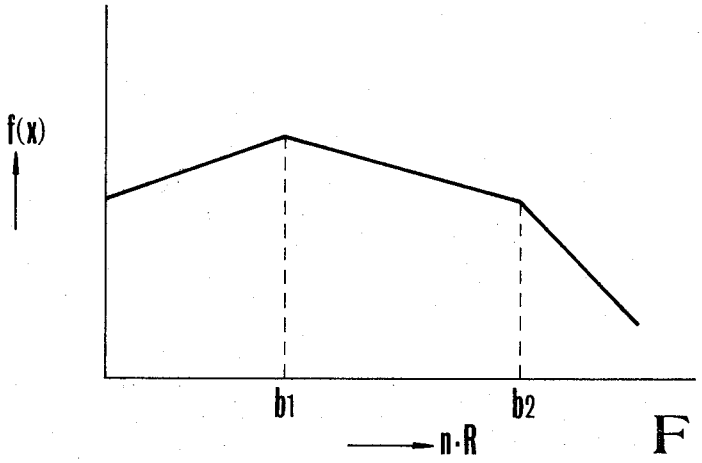

One of the features lies in that values obtained by suitably varying the variable x of a primary function f(x) are utilized as the amplitude coefficients f(x) corresponding to respective harmonics. For example, for the purpose of generating a musical tone of a format shifting characteristic, it is desirable to obtain an amplitude coefficient function f(x) having a characteristic of segments as shown in FIG. 1, wherein up to an order of a harmonic shown by a reference order number b1 corresponding to a first changing point of the amplitude coefficient function f(x) the variable x of the function f(x) is selected as x=a1 corresponding to the amplitude difference a1 between respective harmonic components and this variable x=a1 is successively added, thereby obtaning the amplitude coefficients f(x) for respective harmonic orders up to the reference order number b1. Then, up to a harmonic order number represented by a reference order number b2 corresponding to a second changing point the variable x of the function f(x) is determined as x=−a2 corresponding to the difference −a2 in the amplitude levels (amplitude increment) between respective harmonic components up to the reference order number b2 and this variable x=−a2 is successively added to the amplitude coefficients at respective harmonic order numbers shown by b1. In this manner, the amplitude coefficients f(x) for respective harmonic components up to the reference order number b2 can be obtained. Thus, up to the Wth order of the harmonic, it is possible to determine the amplitude coefficients f(x) of respective harmonic components by selecting the variable x of the primary function f(x) to be x=−a3. According to this principle, by suitably selecting the reference order numbers b1 and b2 corresponding to the variable x (a1, −a2, −a3) of the primary funcion f(x) it is possible to readily determine the amplitude coefficients for respective harmonics. Also, it is possible to complicatedly vary with time the amplitude coefficients by varying with time the variable (x) of the reference order numbers b1 and b2.

Where it is desired to generate an amplitude coefficient f(x) for a musical tone having a formant fixed characteristic, as it is necessary to set the amplitude coefficient f(x) for the frequency number n·R of each harmonic (where n represents the order number and R the frequency information) the values b1 and b2 representing the switching frequencies of the variable x may be set as the reference frequency values.

A preferred embodiment of the electronic musical instrument of this invention will now be described with reference to FIG. 3 which comprises a key switch circuit provided for a keyboard and includes a plurality of key switches corresponding to respective keys of the keyboard. Thus, when a given key is depressed a corresponding key switch is operated to produce logical "1" output as well as a key-on signal KON showing that one of the keys has been depressed. The electronic musical instrument further comprises a one shot circuit 2 triggered by the building-up portion of the key-on signal KON produced by the key switch circuit 1 to produce a narrow width key-on pulse KONP, and a frequency information memory device 3 which stores the frequency information R corresponding to the tone pitches of respective keys at respective addresses. The frequency information memory device 3 is addressed by the output from the key switch circuit 1 to read out the frequency information R corresponding to the tone pitch of the depressed key from the outputs of the frequency information memory device 3. There are also provided a clock pulse generator 4 which generates a clock pulse tc having a constant frequency, for example, 1 MHz, a counter 5 which counts the number of clock pulses tc to produce harmonic calculating timing signals (tc1~tcw) (where w represents the total number of the harmonics to be synthesized at a sampling point) corresponding to the respective orders of harmonics, a delay circuit 6 which delays by a definite time the harmonic calculating timing signal tcw to produce a calculating interval timing signal tx, a counter 7 of a modulo W and adapted to count the number of the clock pulses tc for producing an order number representing order numbers of respective higher harmonics, a multiplier 8 (a harmonic information generator) which multiplies the order number n produced by the counter 7 with the frequency information R produced by the frequency information memory device 3 for producing the product n·R as a harmonic frequency information n·R representing the frequencies of respective harmonics, and a harmonics generator 9 which operates at a predetermined speed the frequency information R produced by the frequency information memory device 3 to sequentially produce, on a time division basis, sine amplitude values of respective harmonics in terms of logarithms log sin $(\pi/w)n \cdot q \cdot R$. The harmonics generator 9 comprises a fundamental phase increment accumulator **9*b* which accumulates the frequency informations R which are applied through a gate circuit 9*a* each time a computation interval timing signal tx is generated by the delay circuit 6 for producing an accumulated value q·R (where q=1, 2 . . .) that designates a sampling point at which data for calculating the amplitude of the musical tone wave is sampled, a gate circuit 9*c* which passes the accumulated value each time a clock pulse tc is generated, a harmonic phase increment accumulator 9*d* responsive to the clock pulses tc passing through the gate circuit 9*c* for sequentially accumulating the accumulated value q·R to form an accumulated value n·q·R showing the phase of the nth (n=1,2 . . . W) harmonic at each sampling point, a memory address decoder 9*e* which decodes the accumulated value, and a sinusoid table 9*f* to read out a sampling point amplitude value corresponding to a given accumulated value n·q·R among respective sampling point values in one period of a sine wave as a sine amplitude value log sin $(\pi/w)n \cdot q \cdot R$ of each harmonic. There are also provided first and second harmonics reference information generators 10 and 11 which vary with time values b1 and b2 representing reference harmonic frequency numbers which are used as references to set respective harmonic amplitude coefficients for producing harmonic reference informations or frequency references b1(t) and b2(t). The harmonics reference information generators 10 and 11 have the same construction, and as shown in FIG. 4, one of them, for example 10, comprises a low frequency pulse oscillator 10*a* of the variable frequency type, a counter 10*d* which, after being reset by the key-on pulse KONP, counts the number of the low frequency pulses applied thereto through an AND gate circuit 10*c* to supply its count to a first frequency reference information memory device 10*b* as an address signal, and an inverter 10*e* which inverts a maximum count of the counter 10*d* and applies its output to one input of the AND gate circuit 10*c* to act as an inhibiting signal. Accordingly, a key-on pulse KONP is produced by the one-shot circuit 2 in response to the operation of a key, and the counter 10*d* is reset by the key-on pulse KONP and then begins to successively count the number of the low frequency pulses generated by the low frequency pulse oscillator 10*a* to supply its count to the first frequency reference information memory device 10*b*. Then, the value b1 stored therein is read out as frequency reference informations b1(t1), b1(t2) . . . which vary with time as the address signal progresses. When the count of the counter 10*d* reaches the maximum value, the AND gate circuit 10*c* is disenabled to stop the counting operation of the counter 10*d*. It should be understood that the period of the low frequency pulse generated by the low frequency pulse oscillator 10*a* is much longer than that of the clock pulse tc, for example several hertzs. The second harmonics reference information generator 11 is substantially identical to the frequency reference information memory device 10*b* except that it stores value b2 instead of value b1 and its hardware construction is the quite same. The values b1 and b2 are set such that b1<b2**.

Figure 3:
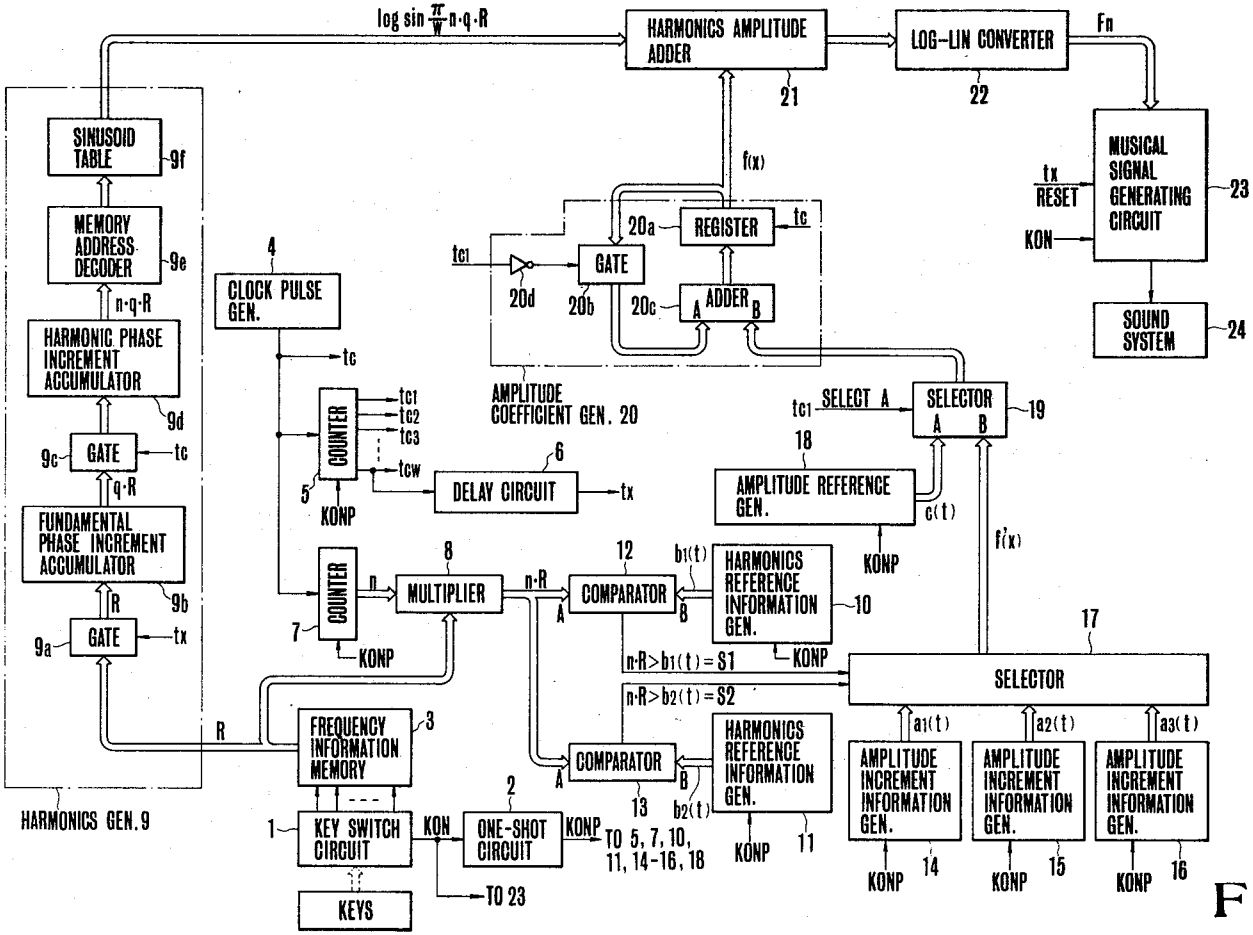
FIG. 3 is a block diagram showing one embodiment of the electronic musical instrument constructed according to the teaching of this invention.
Figure 4:
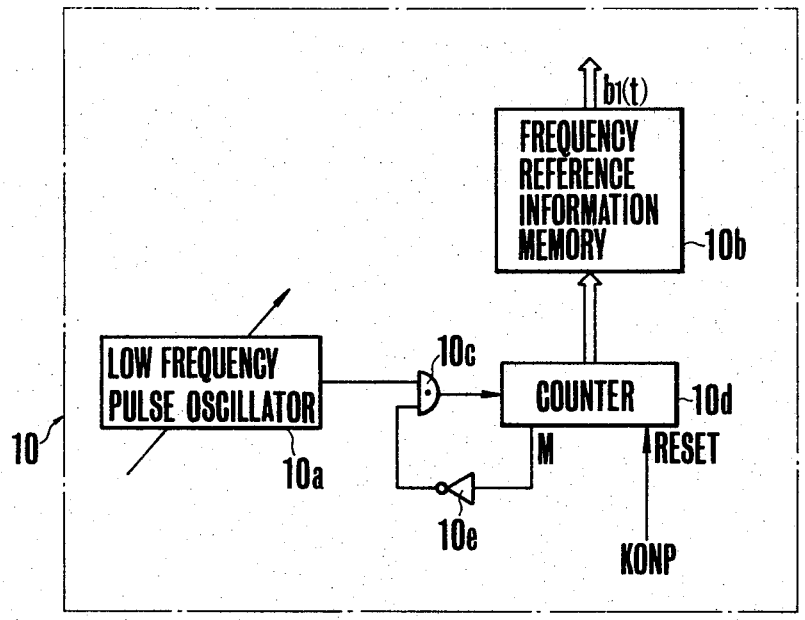
FIG. 4 is a connection diagram showing the detail of a harmonics reference information generator shown in FIG. 3.

The electronic musical instrument shown in FIG. 3 further comprises a first comparator 12 which compares the harmonic frequency information produced by the multiplier 8 with the frequency reference information b1(t) produced by the first harmonics reference information generator 10 for producing a logical output "1" when n·R>b1(t), and a second comparator 13 which compares the harmonic frequency number n·R with the frequency reference information b2(t) generated by the second harmonics reference information generator 11 to produce an output S2 of logical "1" when n·R>b2(t). In short, the outputs S1 and S2 of these two comparators 12 and 13 are shown in the following Table 1.

TABLE 1

| condition of comparison | output S1 of the first comparator 10 | Output S2 of second comparator 11 |
|---|---|---|
| $n \cdot R \leqq b1(t)$ | "0" | "0" |
| $b1(t) < n \cdot R \leqq b2(t)$ | "1" | "0" |
| $n \cdot R > b2(t)$ | "1" | "1" |

There are also provided amplitude increment information generators 14, 15 and 16 which cause data a1, a2 and a3 representing the difference in the amplitude levels of harmonic frequency components or amplitude increments to vary with time to produce amplitude increment informations a1(t), a2(t) and a3(t) respectively and their hardware constructions is substantially the same as that of the first harmonnics reference information generator except that the memory contents are data a1, a2 and a3 instead of data b1 and the oscillation periods of the low frequency pulse oscillator **10*a* are $\tau$a1, $\tau$a2 and $\tau$a3**.

One of the amplitude increment informations a1(t), a2(t) and a3(t) produced by the amplitude increment generators 14, 15 and 16 respectively is selected according to the outputs S1 and S2 of the first and second comparators 12 and 13 and according to the condition of selection shown in the following Table 2 the selected output is produced as an amplitude increment information f'(x) which shows the difference in the amplitude levels between adjacent harmonic frequency components.

TABLE 2

| input signals to be selected | | |
|---|---|---|
| S1 | S2 | selected output |
| "0" | "0" | a1(t) |
| "1" | "0" | a2(t) |
| "1" | "1" | a2(t) |

Thus, for example, when at time t1 the frequency reference informations b1(t) and b2(t) are b1(t1) and b2(t1) respectively, should the harmonic information n·R vary, the selector 17 would produce amplitude increment informations f'(x) as shown in the following Table 3.

TABLE 3

| Time | Selected output |
|---|---|
| $n \cdot R \leqq b1(t1)$ | a1(t1) |
| $b1(t1) < n \cdot R \leqq b2(t1)$ | a2(t1) |
| $n \cdot R > b2(t1)$ | a3(t1) |

An amplitude reference information generator 18 is provided which causes an amplitude level information c regarding the fundamental component (first harmonic) of the musical tone to be generated to vary with time to produce a amplitude reference information c(t) and its hardware construction is substantially the same as that of the aforementioned first harmonics reference information generator 10 except that the memory content is a data c instead of data b1, and that the oscillation period of the low frequency pulse oscillator is $\tau c$.

There are also provided a selector 19, which when the harmonic counting timing signal tc1 (a signal representing the timing for calculating the first harmonic components) is a logical "1", selects the amplitude reference information c(t) applied to an input A, whereas when the calculating timing signal tc1 is a logical "0", that is during an interval between harmonic calculating timing signals tc2 and tcw, selects an amplitude increment information f'(x), and an amplitude coefficient generator 20 which accumulates the amplitude increment informations f'(x) at each clock pulse tc during a period of the amplitude reference information c(t) and succeeding harmonic calculating timing signals tc2~tcw which are applied from the selector 19 each time the harmonic calculating timing signal tc1, thereby setting the amplitude of the accumulated value $$f(x) = c(t) + \sum_{tc2}^{tcw} f'(x)$$

for sine amplitude values log sin $\pi$/w n·q·R of respective harmonics generated by the harmonics generator 9. The amplitude coefficient generator 20 comprises a register 20*a* for storing the accumulated value f(x), an adder 20*c* which adds together the accumulated value f(x) applied thereto through a gate circuit 20*b* and the output of the selector 19, and an inverter 20*d* which inverts the harmonic calculating timing signal tc1 and applies the inverted signal to the gate circuit 20*b* to act as a gate control signal. At a time, when the harmonic calculating timing signal tc1 is generated, the gate circuit 20*b* is disenabled so that only the amplitude reference information c(t) produced by the selector 19 is applied to the adder 20*c* with the result that the information c(t) would be stored in register 20*a* in accordance with the clock pulse tc. When a succeeding harmonic calculating timing signal tc2 is generated, the gate circuit 20*b* is enabled, whereas the selector 19 selects the amplitude increment information f'(x) produced by the selector 19 and applies it to the input B of the adder 20*c*. Accordingly, in response to the harmonic calculating timing signal tc2, the amplitude reference information c(t) stored in the register 20*a* and the amplitude increment information f'(x) and added together by the adder 20*c* to store its sum [c(t)+f'(x)] in the register 20. When the next harmonic calculating timing signal tc3 is generated the accumulated value f(x)=c(t)+f'(x) stored in the register 20*a* is added to the amplitude increment information f'(x) by the adder 20*c* and the sum [c(t)+f'(x)]+[f'(x)] is stored in the registor 20*a* as the accumulated value f(x). Accordingly, the accumulated value f(x) becomes f(x)=c(t)+2f'(x). Such accumulation operation is performed each time one of the calculating timing signals tc2~tcw is generated so that at a time when the harmonic calculating timing signal tcw is generated, the accumulated value in the register 20*a* would be equal to $$\left[ c(t) + \sum_{tc2}^{tcw} f'(x) \right].$$

Further, there are provided a harmonic amplitude adder 21 which adds the sine amplitude values log sin $\pi$/w n·q·R of respective harmonica produced by harmonics generator 9 to the amplitude coefficient f(x) produced by the amplitude coefficient generator 20 to produce an amplitude value Fn= log sin $\pi$/w n·q·R+f(x) of each harmonic component and a logarithmic-linear converter which converts the amplitude value Fn produced by the harmonic amplitude adder 21. At this time, the amplitude value Fn is obtained by an addition operation of a logarithmic value log sin $\pi$/w n·q·R and a further f(x) for the purpose of preventing the format envelope from becoming unnatural. Thus, the amplitude value Fn is expressed by the following equations $$Fn = \log \sin \frac{\pi}{w} n \cdot q \cdot R + f(x)$$

$$\log \sin \frac{\pi}{w} n \cdot q \cdot R + \log [\exp \cdot f(x)]$$

By converting the amplitude value Fn into a natural number, we obtain $$Fn = \sin \frac{\pi}{w} n \cdot q \cdot R \; x \; e^{f(x)}$$

Figure 5:
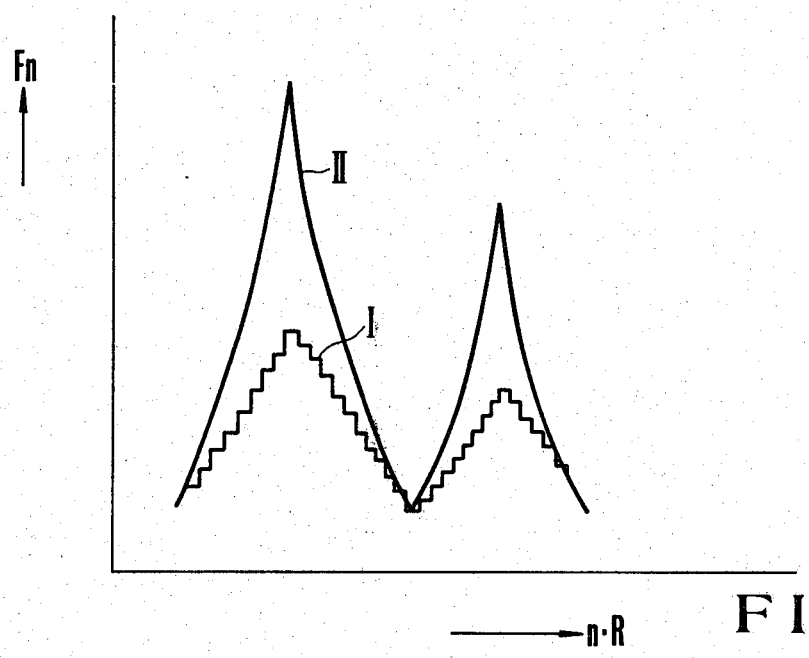
FIG. 5 is a graph showing the variation in the amplitude $F_n$ of respective harmonics produced by a logarithmic-linear converter shown in FIG. 3.
Figure 6:
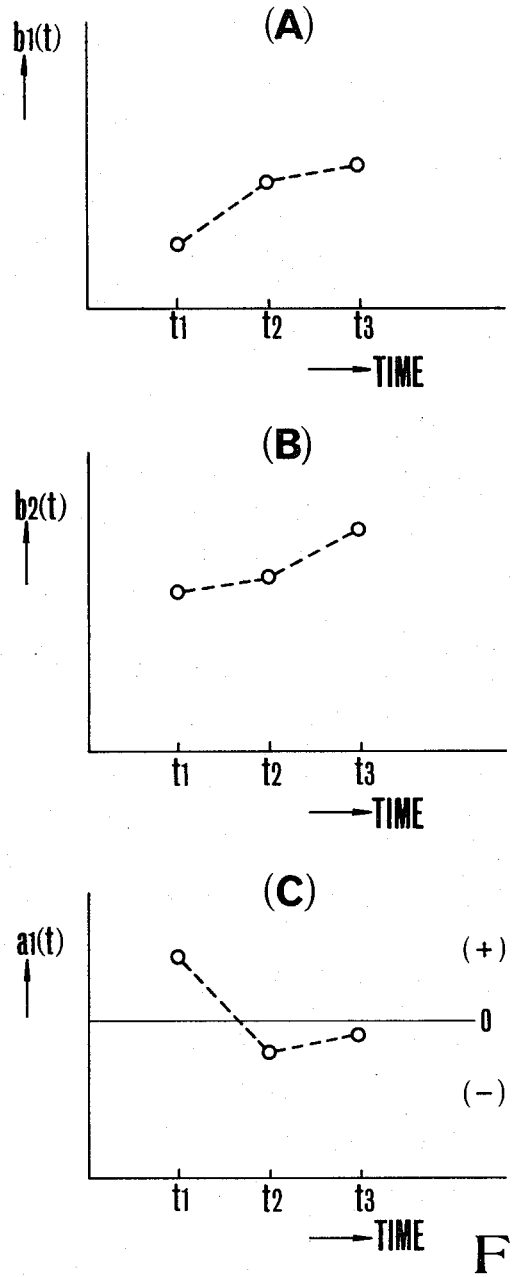
FIGS. 6A through 6F are graphs showing one example of the memory content of the harmonics reference information generator, the amplitude increment information generator, and the amplitude reference information generator shown in FIG. 3.
Figure 6:
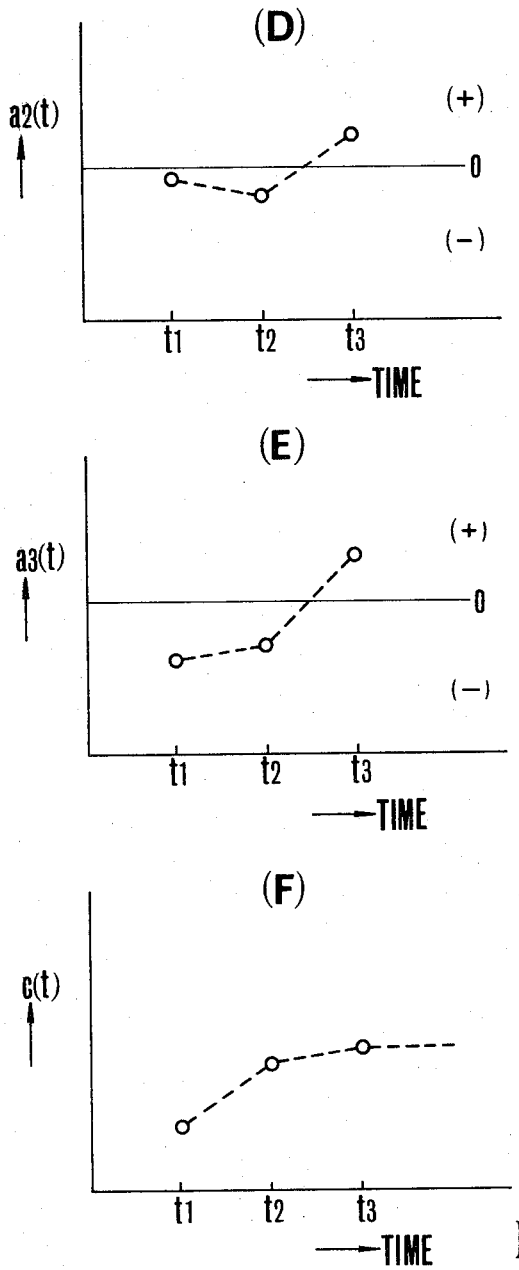

Accordingly, the amplitude value Fn converted into a natural number by the logarithmic-linear converter 22 varies exponentially as shown by curve II in FIG. 5 even when the accumulated value (amplitude coefficient) f(x) varies linearly as shown by curve I, thus increasing the naturalness of the formant envelope. At the same time, even though the amplitude coefficient f(x) may comprise a small number of bits, it is possible to represents a large amplitude value.

There are also provided a musical tone signal generator 23 which produces a musical tone signal by successively accumulating the calculating interval timing each time it is generated and then converting the accumulated value $$\sum_{n=1}^{w} Fn$$

into an analog signal, and a sound system 24 which converts the musical tone signal generated by the musical tone signal generator 23 into a musical tone. Although not shown, as is well known in the art, the sound system 24 is provided with an envelope waveform generator which is started by a key-on signal KON generated by the key switch circuit 1 so as to impart such amplitude envelopes as attack, sustain, and decay to the generated musical tone in accordance with the envelope waveform produced by the envelope waveform generator.

This embodiment operates as follows. Thus, when a key on a keyboard is depressed, a corresponding key switch is closed to produce an "1" signal on a corresponding output line of the key switch circuit 1. This output signal "1" is used to address the frequency information memory device 3 to read out a frequency information R corresponding to the tone pitch of the depressed key. This frequency information R is applied to a harmonics generator 9 and the multiplier 8. The frequency information R applied to the harmonics generator 9 is applied to the fundamental phase increment accumulator **9*b* via the gate circuit 9*a* which is enabled each time a calculating interval timing signal tx is generated to form an accumulated value q·R that designates a sampling point at which an amplitude value of the musical tone waveform is to be calculated. The accumulated value q·R is applied to the harmonic phase increment accumulator 9*d* via the gate circuit 9*c* enabled by the clock pulse tc. Then, the harmonic increment accumulator 9*a* sequentially accumulates the accumulated value q·R in one period of the calculating interval timing signal tx according to the timing of the clock pulse tc in the order of 1·q·R, 2·q·R, 3·q·R . . . , thereby producing an accumulated value n·q·R that designates the phase of the sinusoid wave value at respective sampling points of each harmonic wave. This accumulated value is decoded by the memory address decoder and then is used to address the sinusoid table 9f** to read out, on the time division basis, the sine wave value log sin $\pi/w$ n·q·R of each harmonic. Similar operation is performed at each sampling point of the musical tone wave corresponding to the tone pitch of the depressed key whenever a calculating interval timing signal tx is generated.

The counter 7 counts the number of clock pulses tc to supply its output to the multiplier 8 as an order number n which is multiplied with the frequency information R in the multiplier 8 and the product n·R is applied to the first and second comparators 12 and 13 to act as the harmonic frequency information n·R of each harmonic component to be produced.

Assume now that the respective addresses of the memory devices of the first and second harmonics reference information generators 10 and 11, the amplitude increment generators 14, 15 and 16, and the amplitude reference information generator 19 are respectively storing data b1(t), b2(t), a1(t), a2(t), a3(t) and c(t), then these data are read out from these information generators 10, 11, 14, 15, 16 and 18 at independent speeds thereby producing a amplitude reference information c1(t), reference frequency informations b1(t) and b2(t), and amplitude increment informations a1(t), a2(t) and a3(t) respectively. The informations produced by these information generators 10, 11 14~16 and 18 in this manner are sequentially counted-up after the counter **10*d*** has been reset by a key-on pulse KONP so that at first, the contents stored in the leading addresses of the memory devices are read out as data c1(t1), b1(t1), b2(t1), a1(t1), a2(t1) and a3(t1).

Among these informations generated in this manner, the amplitude reference information c(t1) is selected by the selector 19 during the duration of the harmonic calculating timing signal tc1 and applied to the amplitude coefficient generator 20 as the initial value of the amplitude coefficient f(x). At this time, since the gate circuit **20*b* is disabled by a harmonic wave calculating timing signal tc1, the amplitude reference information c(t1) supplied from the selector 19 is stored by the clock pulse tc in register 20*a* without any change, so that the amplitude reference information stored in register 20*a*** is produced as the amplitude coefficient f1(x) for the first harmonic wave (fundamental wave).

During the next harmonic calculating timing signal tc2, the order number n becomes equal to 2 in synchronism with this timing signal tc2. Accordingly, the harmonic frequency information n·R produced by the multiplier 8 becomes "2·R", and this harmonic frequency information 219 R is compared with the reference frequency informations b1(t1) and b2(t1) by the first and second comparators 12 and 13 under the conditions of comparison as shown in Table 1. At this time, if 2·R≦b1(t1) and 2·R≦b2(t1), the first and second comparators produce output S1="0" and S2="0", respectively. In response to these outputs of the comparators, the selector 17 selects the amplitude increment information a1(t1) produced by the amplitude increment information generator 14 and produces an amplitude increment information f'1(x) between the first and second harmonic components. This amplitude increment information f'1(x) produced by the selector 17 is applied to the amplitude coefficient generator 20 via selector 19. The amplitude increment information f'1(x) and a1(t) supplied to the amplitude coefficient generator 20 are added to the amplitude reference information c1(t1) by the adder **20*c*, which has been stored in the register 20*a* in accordance with the preceding harmonic calculating timing signal tc1 and the sum [c(t1)+f'1(x)] is stored again in the register 20*a*** by the clock pulse tc and then produced as the amplitude coefficient f2(x) of a high frequency component corresponding to 2·R, that is the second harmonic.

During the next harmonic calculating timing signal tc3, in the same manner as the operation during the second harmonic calculating signal tc2, the first and second comparators 12 and 13 compare the harmonic frequency information 3·R with the reference frequency informations b1(t1) and b2(t1), and if the result were 3·R≦b1(t1) and 3·R≦b2(t1), the first and second comparators would produce outputs S1="0" and S2="0", and the selector 17 would produce an amplitude level difference information f'2(x) between the second and third harmonic frequency components as the amplitude increment information. The amplitude coefficient generator 20 adds this amplitude increment information f'2(x) to the accumulated value f2(x)=c(t1)+f'1(x) stored in the register **20*a* and the sum [c(t1)+f'1(x)+f'2(x)]=[c(t1)+2f'1(x)] is stored again in the register 20*a*** and this new accumulated value is produced as a harmonic component amplitude coefficient f3(x) corresponding to 3·R.

Similar operation is repeated for each one of the harmonic calculating timing signals tc4 ~ tcw and when the harmonic frequency information n·R reaches n·R > b1(t1), n·R ≦ b2(t1) the first and second comparators 12 and 13 would produce outputs S1 = "1" are S2 = "0" respectively. Consequently, the selector 17 selects the amplitude increment information generated by the amplitude increment information generator 15 in accordance with the outputs S1 = "1" and S2 = "0" of the first and second comparators for producing an amplitude increment information $f'_n(x)$ between a harmonic component corresponding to (n−1)·R and a harmonic component corresponding to n·R. This amplitude increment information $f'_n(x)$ is added to the accumulated value $f_{n-1}(x)$ between harmonic calculating timing signals tc1 and $tc_{n-1}$ by the amplitude coefficient generator 20 and the sum $f_n(x) = f_{n-1}(x) + f_n'(x)$ is produced as an amplitude coefficient of the harmonic component corresponding to n·R. As the harmonic frequency information n·R becomes larger with the result that when condition n·R > b1(t1) and n·R > b2(t1) hold, the outputs of the first and second comparators 12 and 13 become S1 = "1" and S2 = "1" respectively whereby the amplitude increment information a3(t1) produced by the amplitude increment information generator 16 is selected and sent out as an amplitude increment information f'(x).

Under a condition in which the time parameters of the reference frequency information b1(t1), b2(t1), amplitude increment informations a1(t1), a2(t1), a3(t1) and of the amplitude reference information c(t1) are all t1, the amplitude increment information f'(x) between adjacent harmonic components is switched with the reference frequency informations b1(t1) and b2(t1) utilized as a reference point of variation as the harmonic frequency information n·R varies, in a manner a1(t1)→a2(t1)→a3(t1). Accordingly, as shown by curve I(t1) shown in FIG. 7, the amplitude increment between the harmonic amplitude coefficient f(x) produced by the amplitude coefficient generator 20 and adjacent frequency varies with the variation in the harmonic frequency information n·R. In this case, the curve I(t1) increases upwardly with the variation of the harmonic frequency information n·R when the values of the amplitude increment informations a1(t1), a2(t1) and a3(t1) are positive, whereas decreases downwardly when the values of the amplitude increment informations are negative. Thus, it is possible to vary as desired the varying characteristic of the amplitude coefficient f(x) by setting the values of the amplitude increment information a1, a2 and a3 to positive or negative.

Figure 7:
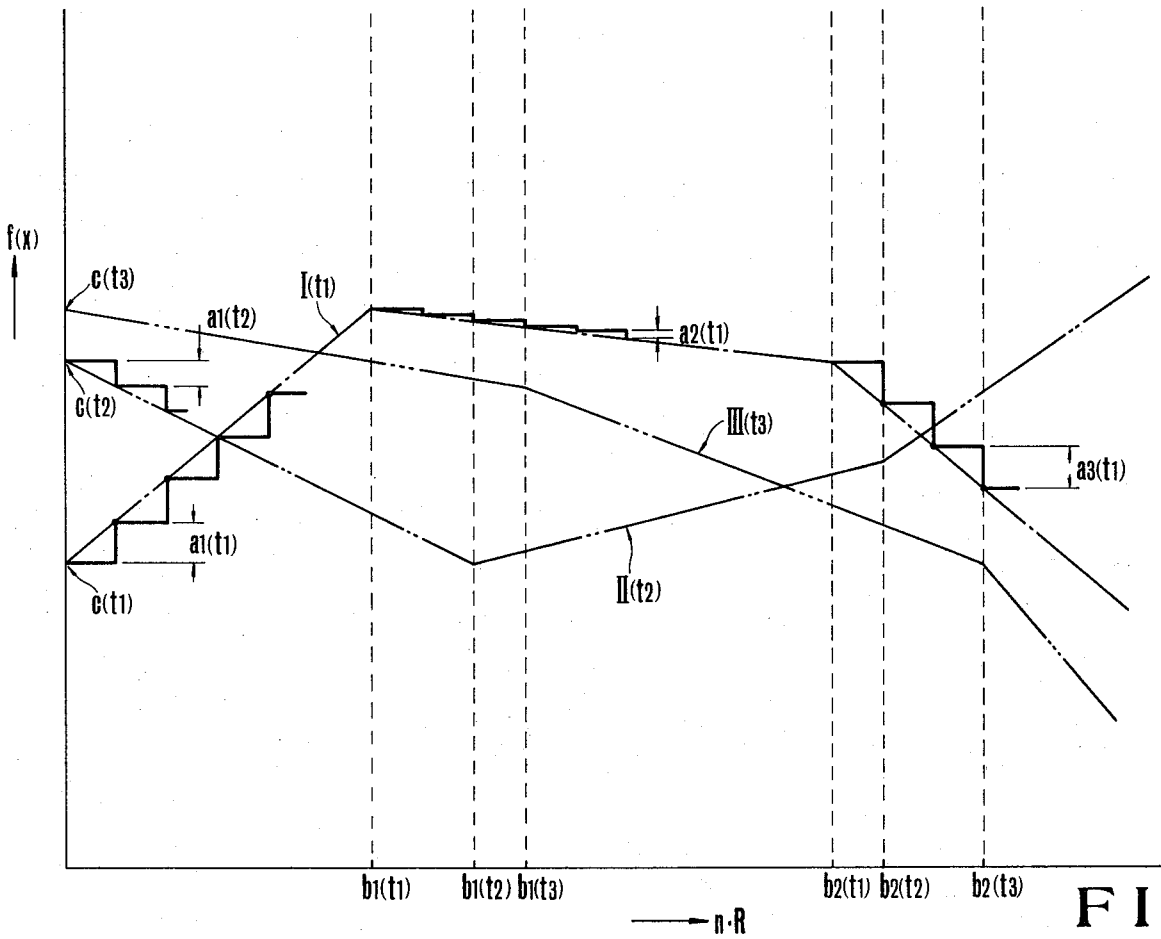
FIG. 7 is a graph showing the manner of varying the amplitude coefficient f(x)

The amplitude coefficient f(x) which varies according to curve I(t1) shown in FIG. 7 is repeatedly produced by the amplitude coefficient generator 20 while the time parameter t of the reference frequency informations b1(t1), b2(t) and of the amplitude increment informations a1(t), a2(t) and a3(t) is equal to t1 but when the parameter t changes to t2, new reference frequency informations b1(t2) and b2(t2) and new amplitude increment information a1(t2), a2(t2) and a3(t2) are generated. Also the amplitude reference information c(t1) becomes a new value c(t2). For this reason, under a condition of time [t2,] initial value of the amplitude coefficient f(x) is equal to c(t2) and its variation is shown by curve II(t2) in FIG. 7. As the time reaches t3, the amplitude coefficient f(x) varies as shown in curve III(t3) of FIG. 7. Accordingly, the amplitude coefficient f(x) varies variously with time and hence its point at which the reference varies also varies with time. At this time, the shape of the envelope which varies with the variation in the amplitude coefficient f(x) of the harmonic can be determined by selecting suitable values of the reference frequency informations b1(t) and b2(t) and the amplitude increment information a1(t), a2(t) and a3(t). This means that it is possible to determine to any desired shape the formant envelope of a musical tone to be generated in accordance with the values of these informations, thus making it possible to control the formant envelope to be coincident with the tone feeling.

The amplitude coefficient f(x) corresponding to each harmonic frequency information n·R wherein the amplitude increment between adjacent harmonic components produced by the amplitude coefficient generator 20 is added to the sine wave value log sin (π/w) n·q·R of each harmonic produced by the harmonics generator 9 by the harmonic amplitude adder 21 so as to set the amplitude value Fn for the sine amplitude value log sin π/w n·q·R of each harmonic. The amplitude value $$Fn = \log \sin \frac{\pi}{w} n \cdot q \cdot R + f(x)$$

produced by the harmonic amplitude adder 21 is converted into a natural value $$Fn = \sin \frac{\pi}{w} n \cdot q \cdot R \times e^{f(x)}$$

by the logarithmic-linear converter 22, and this natural value is applied to the musical tone signal generator 23.

The musical tone signal generator 23 accumulates the amplitude value of each harmonic supplied from the logarithmic-linear converter 22 each time a calculating interval timing signal t(x) is generated. The accumulated value $$\sum_{n=1}^{w} Fn$$

is converted into a corresponding analogue signal which is supplied to the sound system 24 as a musical tone signal. Then the sound system 24 produces a musical tone having a formant fixed characteristic whose tone varies with time in accordance with the formant envelope determined by the preset amplitude reference information c(t), the reference frequency information b1(t) and b2(t) and amplitude level difference informations a1(t), a2(t) and a3(t).

While in the foregoing description, it was assumed that the speeds of variations with time of respective informations c(t), b1(t), b2(t), a1(t), a2(t) and a3(t) are all equal, it is only for the convenience of description. Actually, however, these speeds of variations with time are different as has been described with reference to the construction of the electronic musical instrument.

Accordingly, the envelope coefficient of the amplitude coefficient f(x) shown in FIG. 5 varies more complicatedly.

Figure 8:
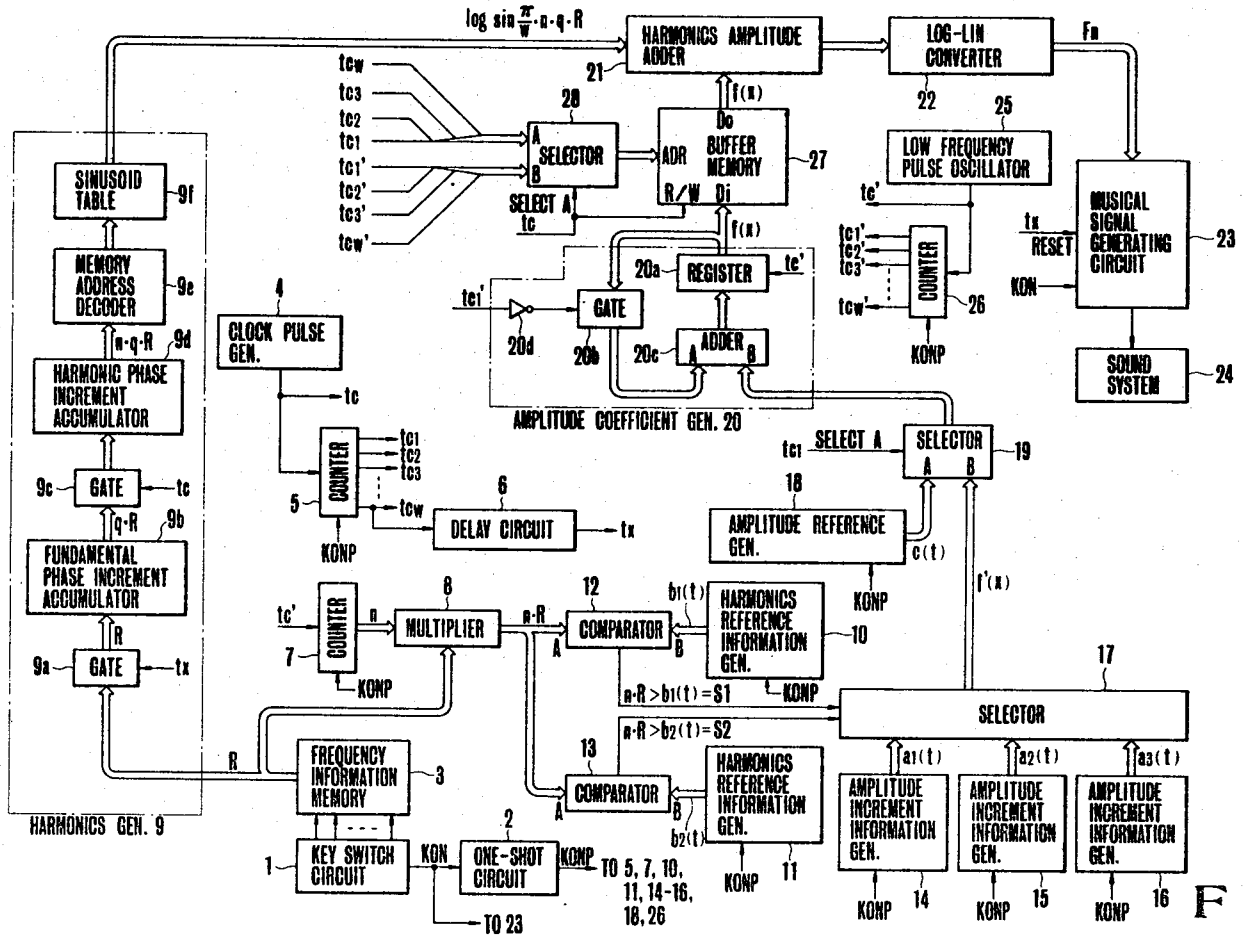
FIG. 8 is a block diagram showing a modified embodiment of the electronic musical instrument embodying the invention.

FIG. 8 is a block diagram showing another embodiment of this invention, in which the arithmetic operation of the amplitude coefficient f(x) is made in a period longer than that the clock pulse tc. For the sake of brevity only points different from those shown in the block diagram shown in FIG. 1 will be described as follows. More particularly, there are provided a low frequency pulse oscillator 25 which produces a low frequency clock pulse tc' having a much longer period (for example 1 KHz) than the period of the clock pulse tc, and a counter 26 which counts the number of the clock pulses tc, for producing calculating timing signals tc'~tcw' for calculating the amplitude coefficient f(x) corresponding to each harmonic.

The calculating timing signal tc1' produced by the counter 26 is applied to the inverter 20*d* of the amplitude coefficient generator 20, whereas the aforementioned low frequency clock pulse tc' is applied to the register 20*a* of the amplitude coefficient generator 20 to act as a set timing signal. This clock pulse is also applied to a counter 7 as a count signal for producing an order number n. For this reason, the order number n varies with a long period corresponding to the period of the low frequency clock pulse tc'. Also the accumulating operation of the amplitude increment information f'(x) of the accumulator 20 is done with a longer period. As a consequence, the amplitude coefficient f(x) produced by the accumulator 20 varies successively each time the low frequency clock pulse tc' is generated. A buffer memory device 27 is provided for temporarily storing the amplitude coefficient f(x) produced by the amplitude coefficient generator 20 and then sequentially reads out the amplitude coefficient with harmonic calculating signals tc2~tcw having shorter period. The read out output is applied to the harmonics amplitude adder 21 to act as an amplitude coefficient for setting the amplitude value Fn of each harmonic. The buffer memory device 27 acts in a read mode when the clock pulse tc is a logical "1", whereas in a write mode when the clock pulse tc is a logical "0". There is also provided a selector 28 which selects calculating timing signals tc1~tcw of shorter period which are applied to input A when the clock pulse tc is a logic "1", whereas, when the clock pulse tc is a logical "0", selects the calculating timing signal tc1'~tcw' having a longer period and applied to input B. Accordingly, the accumulating operation of the amplitude increment information f'(x) by the amplitude coefficient generator 20 is performed over a long period corresponding to the period of the low frequency clock pulse tc' and the result of accumulation is stored in an address corresponding to the calculating timing signals tc1~tcw of the buffer memory device 27 when the clock pulse tc is a logical "0". The memory content f(x) is then read out by the harmonic calculating timing signals tc1~tcw of a shorter period when the clock pulse tc is a logical "0" to produce an amplitude coefficient f(x) for the sine amplitude log sin $(\pi/w)n \cdot q \cdot R$ of the corresponding harmonic. Thus, in this modification, too, a similar effect as that of the electronic musical instrument shown in FIG. 1 can be expected. Especially, according to this modification since the calculation of the amplitude coefficient f(x) is made over longer period, the arithmetic operation circuit for calculating the amplitude coefficient f(x) can be constituted with a microcomputer, thus simplifying the construction.

Although in the embodiments of this invention shown in FIGS. 3 and 8, the amplitude coefficient f(x) was varied sequentially by a harmonic frequency information n·R representing each one of the harmonic components, it is also possible to vary sequentially the amplitude coefficient f(x) by only order number n, in which case the resulting musical tone manifests a formant shifting characteristic. More particularly, in this case, the reference frequency informations b1(t) and b2(t) are used as the reference order number informations b1(t) and b2(t), and an information inputted to A side inputs of the comparators 12 and 13 is used as an order number n produced by the counter 48.

As above described, the electronic musical instrument of this invention comprises a plurality of amplitude increment generators which produce as their outputs the amplitude increments between adjacent order numbers or between adjacent harmonics, the outputs varying with time, a frequency (or order number) reference information generator for producing as its output a harmonic order number representing a point at which the amplitude coefficient varies or a harmonic frequency information which varies with time, a comparator which compares the frequency (or order number) reference information generated by the frequency (or order number) reference information generator with a harmonic order number or a harmonic frequency information, a selector responsive to the output of the comparator for selecting one of the amplitude increment informations generated by the plurality of amplitude increment information generators, and an amplitude coefficient generator which accumulates at a predetermined speed the selected amplitude increment information for converting the accumulated value into the amplitude coefficient for each harmonic order number or each harmonic. For this reason, the amplitude coefficients for respective harmonic components vary variously with time, this varying with time the tone color of the generated musical tone. Since the control of the tone color which varies with time can be made by the setting of only the frequency (or order number) reference and the amplitude increment, the circuit construction can be simplified, thereby changing the tone color as desired. Especially, where the frequency (or order number) reference information and the amplitude information are selected suitably, it is possible to set the tone color of the generated musical tone in accordance with a desired formant envelope whereby it becomes possible to control in unison the formant envelope and the tone feeling.

What is claimed is:

1. An electronic musical instrument comprising first means for producing harmonic components inclusive of a fundamental wave; second means for generating amplitude coefficients respectively corresponding to said harmonic components; means for multiplying an output of said first means with an output of said second means to obtain products; means to synthesize said products for forming a musical tone; said second means comprising means for generating at least one increment value, and means for repeatedly accumulating the increment value thus generated, thereby obtaining a plurality of values which constitute ordinate values of a plotted line as depicted by a graph, said plotted line being a frequency characteristic curve, said obtained values defining amplitude coefficients for said harmonic components; harmonic information generating means for generating harmonic information representing pitches of respective harmonic components which form a musical tone to be generated; harmonic reference information generator means for generating harmonic reference information representing a pitch; comparator means for sequentially comparing an output of said harmonic information generating means and an output of said harmonic reference information generator means; and means responsive to an output of said comparator means for selecting one of said increment component generating means.

2. An electronic musical instrument according to claim 1 wherein each one of said harmonic components is generated on a time division basis, and said accumulating means comprises means for accumulating said increment value in synchronism with the generating of said harmonic components, and means for setting an initial value of accumulation.

3. An electronic musical instrument according to claim 1 wherein said increment value generating means comprises means for varying with time the increment value.

4. An electronic musical instrument according to claim 2 wherein said increment value generating means comprises a plurality of means for generating different increment values, and a selector for selecting one of said increment value generating means, and wherein said means for setting the initial value of accumulation comprises an initial value setting means for each said increment value generating means.

5. An electronic musical instrument comprising first means for producing harmonic components inclusive of a fundamental wave; second means for generating amplitude coefficients respectively corresponding to said harmonic components; means for multiplying an output of said first means with an output of said second means to obtain products; and means to synthesize said products for forming a musical tone; said second means comprising means for generating at least one increment value, and means for accumulating the increment value thus generated, thereby forming amplitude coefficients that define a frequency characteristic curve for said harmonic components, each one of said harmonic components generated on a time division basis, said accumulating means including means for accumulating said increment value in synchronism with the generation of said harmonic components, and means for setting an initial value of accumulation, said increment value generating means including a plurality of means for generating different increment values and a selector for selecting one of said increment value generating means, said means for setting the initial value of accumulation including an initial value setting means respectively corresponding to each said increment value generating means, said selector including harmonic information generating means for generating harmonic information representing pitches of respective harmonic components which form a musical tone to be generated, a harmonic reference information generator for generating a harmonic reference information representing a pitch, comparator means for sequentially comparing an output from said harmonic information generating means and an output of said harmonic reference information generator, and means responsive to an output of said comparator means for selecting one of said increment component generating means.

6. An electronic musical instrument according to claim 5 wherein said harmonics reference information generator comprises means for varying with time said harmonic reference information.

7. An electronic musical instrument according to claim 5 wherein said harmonic reference information comprises an order number of said harmonic components.

8. An electronic musical instrument according to claim 5 wherein said harmonic reference information is an information representing a harmonic frequency.

9. An electronic musical instrument comprising first means for producing harmonic components inclusive of a fundamental wave; second means for generating amplitude coefficients respectively corresponding to said harmonic components; means for multiplying an output of said first means with an output of said second means to obtain products; and means to synthesize said products for forming a musical tone; said second means comprising means for generating at least one increment value, and means for accumulating the increment value thus generated, thereby forming amplitude coefficients that define a frequency characteristic curve for said harmonic components, said harmonic components being generated on a time division basis at a first clock rate and said accumulating means accumulating said increment values at a second clock rate slower than said first clock rate thereby generating respective ones of said amplitude coefficients, said accumulating means including means for setting an initial value of accumulation each time the amplitude coefficient for said fundamental wave is generated, a buffer memory device inputted with and storing said amplitude coefficients generated by said accumulating means, and means for reading said stored amplitude coefficients from said buffer memory device at said first clock rate at timings respectively corresponding to the generation of said harmonic components.

* * * * *